US006384089B1

(12) United States Patent
Tomida

(10) Patent No.: US 6,384,089 B1
(45) **Date of Patent: *May 7, 2002**

(54) AQUEOUS LIQUID FOR FORMING SOAP BUBBLES

(75) Inventor: Masaaki Tomida, Tokyo (JP)

(73) Assignee: Mitsubishi-Kagaku Foods Corp, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/071,458

(22) Filed: May 1, 1998

(30) Foreign Application Priority Data

May 6, 1997 (JP) ..... 9-131746

(51) Int. Cl.[7] ..... B01F 17/34; B01F 17/00; A63H 33/28; C11D 1/66; C11D 1/83

(52) U.S. Cl. ..... 516/18; 426/104; 426/564; 446/15; 516/14; 516/19

(58) Field of Search ..... 516/18, 14, 19; 446/15; 510/135, 218; 426/564, 104

(56) References Cited

U.S. PATENT DOCUMENTS

| | | | | | |
|---|---|---|---|---|---|
| 2,433,625 | A | * | 12/1947 | Raspet | 516/14 |
| 2,469,045 | A | * | 5/1949 | La Vietes | 516/14 |
| 2,959,887 | A | * | 11/1960 | Remeika | 46/6 |
| 3,867,301 | A | * | 2/1975 | Watanabe et al. | 510/535 |
| 4,511,497 | A | * | 4/1985 | Ehlrich | 510/536 |
| 4,587,130 | A | * | 5/1986 | Stauber | 426/564 |
| 5,109,127 | A | * | 4/1992 | Sekiguchi et al. | 536/115 |
| 5,246,631 | A | * | 9/1993 | Halbritter | 252/700 |
| 5,962,058 | A | * | 10/1999 | Ono et al. | 426/564 |
| 6,008,172 | A | * | 12/1999 | Broshi et al. | 510/135 |
| 6,056,983 | A | * | 5/2000 | Broshi et al. | 426/104 |
| 6,303,164 | B2 | * | 10/2001 | Cottone et al. | 426/104 |
| 2001/0003595 | A1 | * | 6/2001 | Cottone et al. | 426/104 |

FOREIGN PATENT DOCUMENTS

| | | |
|---|---|---|
| JP | 55-131364 | * 10/1980 |
| JP | 57-106606 | * 7/1982 |
| WO | WO 95/33387 | * 12/1995 |
| WO | WO 97/26076 | * 7/1997 |

OTHER PUBLICATIONS

DWPI on WEST, week 198048, London: Derwent Publications Ltd., AN 1980–85030C, JP 55131364 (Lion Corp.) abstract, 1980.*

Chemical Abstracts, vol. 97, No. 16 (Columbus, OH, USA) p. 384, col. 2, Oct. 18, 1982 Abstract No. 97:133369, Sunstar, Inc., JP 57106606 A2.*

Database WPIL on STN, week 8232, London: Derwent Publications Ltd., AN 82–66894E, JP 57–106606 A (Sunstar KK) abstract, Oct. 1982.*

* cited by examiner

*Primary Examiner*—Daniel S. Metzmaier
(74) *Attorney, Agent, or Firm*—David G. Conlin; Lisa Swiszcz Hazzard; Edwards & Angell, LLP

(57) ABSTRACT

An aqueous liquid for forming soap bubbles of the present invention, contains, as an emulsifier, an ester of a fatty acid having 8 to 14 carbon atoms with a polyhydric alcohol having not less than four hydroxyl groups, the percentage of esterified hydroxyl groups of said polyhydric alcohol being 1 to 25% based on total hydroxyl groups of the polyhydric alcohol. Such aqueous liquid for forming soap bubbles has a high safety and is suitable for children's recreations or amusements.

10 Claims, No Drawings

AQUEOUS LIQUID FOR FORMING SOAP BUBBLES

BACKGROUND OF THE INVENTION

The present invention relates to an aqueous liquid for forming soap bubbles, and more particularly, to an aqueous liquid for playing to form soap bubbles, which is prepared by using edible raw materials, has a high safety and is suitable for children's recreations or amusements.

With change in social environments, indoor games such as personal computer games have extensively prevailed as children's recreations. However, since such indoor recreations keep children in their rooms all day long, outdoor recreations have been recently recommended to protect children from being adversely influenced by these indoor games. Bubble blowing play is one of most popular outdoor recreations for children. Meanwhile, as a solution for forming bubbles, there have been used a soapy water, etc., which are capable of readily forming soap bubbles upon blowing. When the soapy water is blown upon playing, it is likely that children erroneously suck the soapy water in their mouths. However, soap has a bitter taste and, therefore, is unfavorable as a raw material of the aqueous liquid for forming soap bubbles. Further, there arises a problem that children, especially infants, tend to erroneously drink in or swallow the soapy water upon playing.

SUMMARY OF THE INVENTION

As a result of the present inventors' earnest studies for solving the above-mentioned problems, it has been found that an aqueous liquid for forming soap bubbles, containing a specific ester of fatty acid with polyhydric alcohol, which is capable of forming soap bubbles upon blowing, has substantially no bitter taste and can show a high safety upon erroneously drinking. The present invention has been attained on the basis of the finding.

It is an object of the present invention to provide an aqueous liquid for forming soap bubbles showing a high safety even when the aqueous liquid is erroneously drunk in or swallowed, aid therefore, being suited for children's recreations or plays.

To accomplish the aim, in a first aspect of the present invention, there is provided an aqueous liquid for forming soap bubbles, which comprises, as an emulsifier, an ester of a fatty acid having 8 to 14 carbon atoms with a polyhydric alcohol having not less than four hydroxyl groups, the percentage of esterified hydroxyl groups of the polyhydric alcohol being 1 to 25% based on total hydroxyl groups of the polyhydric alcohol.

In a second aspect of the present invention, there is provided a method of preparing an aqueous liquid for forming soap bubbles, which contains, as an emulsifier, an ester of a fatty acid having 8 to 14 carbon atoms with a polyhydric alcohol having not less than four hydroxyl groups, wherein the percentage of esterified hydroxyl groups of said polyhydric alcohol based on total hydroxyl groups thereof is 1 to 25% based on total hydroxyl groups of the polyhydric alcohol, for using as an aqueous liquid for forming soap bubbles.

In a third aspect of the present invention, there is provided a method of forming soap bubbles using an aqueous liquid comprising, as an emulsifier, an ester of a fatty acid having 8 to 14 carbon atoms with a polyhydric alcohol having not less than four hydroxyl groups, wherein the percentage of esterified hydroxyl groups of said polyhydric alcohol based on total hydroxyl groups thereof is 1 to 25%, for preparing an aqueous liquid for forming soap bubbles.

DETAILED DESCRIPTION OF THE INVENTION

The present invention will be described in detail below.

In an aqueous liquid for forming soap bubbles (hereinafter referred to merely as "soap-bubbling aqueous liquid") according to the present invention, in order to obtain an excellent bubble-forming property, there can be used an ester of a fatty acid having 8 to 14 carbon atoms with a polyhydric alcohol having not less than four hydroxyl groups, in which the percentage of esterified hydroxyl groups of the polyhydric alcohol is 1 to 25% based on total hydroxyl groups of the polyhydric alcohol. When the number of carbon atoms of the fatty acid is less than 8 or more than 14, the obtained soap-bubbling aqueous liquid cannot exhibit a sufficient bubble-forming property.

Typical examples of the fatty acid moiety may include caprylic acid, capric acid, lauric acid, myristic acid or the like. Among them, fatty acids composed mainly of myristic acid are preferred from the viewpoint of taste. The content of myristic acid in the preferred fatty acids is preferably not less than 30% by weight, more preferably 40 to 100% by weight based on the weight of the fatty acids.

Typical examples of the polyhydric alcohol moiety may include sugars or sugar alcohols such as sucrose, sorbitol, glucose, fructose, maltose, raffinose, lactose, xylose, mannitol, erythritol or maltitol, sugar alcohol derivatives such as polyoxyethylene sorbitan, glycerols such as polyglycerol, or the like. Among them, sucrose and polyglycerol are preferred. Further, as the polyglycerols, those having a polymerization degree of not less than 4 are more preferred.

The percentage of esterified hydroxyl groups of the polyhydric alcohol is usually 1 to 25%, preferably 5 to 22% based on total hydroxyl group of the polyhydric alcohol. When the percentage of esterified hydroxyl groups of the polyhydric alcohol is more than 25%, the obtained soap-bubbling aqueous liquid is deteriorated in bubble-forming property. Such a percentage of esterified hydroxyl groups of the polyhydric alcohol may be determined according to the following method.

That is, for example, in the case of sucrose fatty ester, there can be adopted a method of separating the ester into individual components which are different in percentage of esterified hydroxyl groups of the polyhydric alcohol from each other, by gel permeation chromatography (GPC), and calculating the percentage of esterified hydroxyl groups from peak areas of the respective components. In the gel permeation chromatography, "TSK-gel G2500HXL" produced by TOSO CO., LTD. may be used as a separation column, and tetrahydrofuran may be used as an eluent. Further, in the case of polyglycerol fatty ester, there may be adopted a method of calculating the percentage of esterified hydroxyl groups from the ratio of polyglycerol to fatty acid charged into a reactor upon reaction and the amount of residual polyglycerol after the reaction. In this case, the separation of the residual polyglycerol may be conducted, for example, by a liquid-liquid extraction method using an aqueous solution containing isobutyl alcohol and sodium sulfate.

The fatty acid esters used in the present invention are preferably selected from the emulsifer being approved as food additives.

The soap-bubbling aqueous liquid according to the present invention can be produced by dissolving the above-mentioned fatty ester as an emulsifier in water. The amount of the fatty ester used is usually 0.1 to 10% by weight, preferably 0.5 to 5% by weight based on the weight of the soap-bubbling aqueous liquid.

The soap-bubbling aqueous liquid according to the present invention may usually contain a thickener to impart an appropriate viscosity thereto. Especially, thickeners used as foods or food additives are more preferred. Typical examples of the thickeners may include thickened polysaccharides. Specific examples of the preferred thickeners may include microbe-yielded viscous materials such as xanthan gum, gellan gum, pullulan or curdlan; plant seed viscous materials (mucilage derived from seed) such as guar gum (guaran), locust bean gum, tamarind seed gum or tara gum; sea weed extracts such as carrageenan or agar; vegetable resin viscous materials (mucilage derived from vegetable resin) such as gum arabic, tragacanth gum or karaya gum; plant fruit viscous materials (mucilage derived from plant fruits) such as pectin or arabinogalactan; celluloses such as methyl cellulose, hydroxymethyl cellulose or hydroxypropyl cellulose; starches such as starch or modified starch; or the like. In addition, as the thickeners, there can also be used animal proteins such as gelatin, albumin or casein, and plant proteins such as soybean protein or wheat protein. These thickeners can be used singly or in the form of a mixture of any two or more thereof.

The amount of the thickener used is varied depending upon kind and aimed viscosity thereof. In the case of thickened polysaccharides, the amount of the thickener used therefor is usually 0.001 to 5% by weight, preferably 0.01 Lo 0.2% by weight based on the weight of the soap-bubbling aqueous liquid.

Further, the soap-bubbling aqueous liquid according to the present invention may contain various other additives preferably which are approved as foods or food additives, if required.

For example, the use of an ionic emulsifier such as an organic acid monoglycerol ester or the like as the other additives can suitably enhance the solubility of the polyhydric alcohol fatty ester. The amount of such an ionic emulsifier used is usually 0.1 to 20% by weight, preferably 1 to 10% by weight based on the weight of the polyhydric alcohol fatty ester. These emulsifiers can be used singly or a mixture thereof.

Also, the addition of sugars to the soap-bubbling aqueous liquid can impart a sweetness, can improve in its favorableness, and is useful to stabilize properties of the soap-bubbling aqueous liquid. As such sweetenings, there can be used saccharides or sugar alcohols. Specific examples of the saccharides may include sucrose, glucose, fructose, maltose, maltotriose, raffinose, lactose, xylose, galactose or the like. In addition, specific examples of the sugar alcohols may include mannitol, sorbitol, glycerol, erythritol, maltitol, lactitol or the like. The amount of the sweetenings added is varied depending upon the intended product, and is usually 0.1 to 20% by weight, preferably 0.1 to 10% by weight based on the weight of the soap-bubbling aqueous liquid. Further, in addition to the above-mentioned additives, the soap-bubbling aqueous liquid may appropriately contain perfumes, colorants, souring agents, preservatives, alcohols or the like.

The soap-bubbling aqueous liquid according to the present invention is less bitter taste when sucked into mouth and suitable for bubble blowing play. Further, the soap-bubbling aqueous liquid is safe even when erroneously drunk in or swallowed and capable of forming soap bubbles by blowing air thereinto.

EXAMPLES

The present invention will be described in more detail by examples, but these examples are not intended to limit the scope of the present invention.

Examples 1 to 5 and Comparative Examples 1 to 3

Emulsifiers (polyhydric alcohol fatty esters), thickeners and sweetenings shown in Table 1 were respectively dissolved in distilled water to obtain soap-bubbling aqueous liquids having compositions shown in Table 2. The thus obtained soap-bubbling aqueous liquids were evaluated with respect to bubble-forming property and low-temperature fluidity thereof according to the following methods (1) and (2). The results are shown in Table 2.

(1) Bubble-forming Property:

A straw having a ring at its tip end was dipped in the soap-bubbling aqueous liquid, thereby applying the solution to the tip end portion thereof. Air was blown into the straw from its opposite end to form soap bubbles. The soap bubbles were observed to evaluate a bubble-forming property of the soap-bubbling aqueous liquids. The evaluation is as follows:

○: Bubbles were readily formed and maintained for a sufficient period of time.

X: Bubbles were broker immediately, or no bubbles were formed.

(2) Low-temperature Fluidity:

The soap-bubbling aqueous liquid was allowed to stand at 10° C. for one day. Thereafter, the soap-bubbling aqueous liquid was evaluated with respect to fluidity and uniformity thereof. The evaluation is as follows:

○: The solution was kept uniform and transparent and exhibited a good fluidity.

Δ: The solution was uniform and transparent, but deteriorated in fluidity.

X: The solution was turbid or precipitated, or exhibited no fluidity.

TABLE 1

| Examples and Comparative Examples | Emulsifier | | | Thickener | Sweetening |
|---|---|---|---|---|---|
| | Kind | Fatty acid in one molecule | Percentage of esterified hydroxyl groups of polyhydric alcohol (%) | Kind | Kind |
| Example 1 | Sucrose fatty ester | Myristic acid | 15 | Xanthan gum | Glycerol |
| Example 2 | Sucrose fatty ester | Lauric acid | 15 | Guar gum | Starch syrup |
| Example 3 | Sucrose fatty ester | Caprylic acid | 14 | λ Carrageenan | Glucose |
| Example 4 | Decaglycerol fatty ester | Lauric acid | 21 | Locust bean gum | Sorbitol |
| Example 5 | Sucrose fatty ester | Myristic acid | 13 | Xanthan gum/guar gum | Sucrose |
| Example 6 | Decaglycerol fatty ester | Myristic acid | 19 | Xanthan gum/guar gum | Sucrose |

TABLE 1-continued

| Examples and Comparative Examples | Emulsifier Kind | Emulsifier Fatty acid in one molecule | Emulsifier Percentage of esterified hydroxyl groups of polyhydric alcohol (%) | Thickener Kind | Sweetening Kind |
|---|---|---|---|---|---|
| Comparative Example 1 | Monoglycerol fatty ester | Stearic acid | 35 | Xanthan gum | Starch syrup |
| Comparative Example 2 | Sucrose fatty ester | Palmitic acid | 15 | Guar gum | Glucose |
| Comparative Example 3 | Decaglycerol fatty ester | Stearic acid | 18 | Locust bean gum | Sucrose |
| Comparative Example 4 | Sucrose fatty ester | Lauric acid | 30 | Guar gum | Starch syrup |

TABLE 2

| Examples and Comparative Examples | Amount added (% by weight) Emulsifier | Amount added (% by weight) Thickener | Amount added (% by weight) Sweetening | Evaluation results Bubble-forming property | Evaluation results Low-temperature fluidity |
|---|---|---|---|---|---|
| Example 1 | 2 | 0.04 | 8 | ○ | Δ |
| Example 2 | 2 | 0.01 | 4 | ○ | ○ |
| Example 3 | 2 | 0.2 | 3 | ○ | ○ |
| Example 4 | 2 | 0.02 | 3 | ○ | ○ |
| Example 5 | 2 | 0.02/0.01 | 5 | ○ | ○ |
| Example 6 | 2 | 0.02/0.01 | 5 | ○ | ○ |
| Comparative Example 1 | 2 | 0.04 | 4 | X | X |
| Comparative Example 2 | 2 | 0.01 | 3 | X | X |
| Comparative Example 3 | 2 | 0.2 | 5 | X | X |
| Comparative Example 4 | 2 | 0.01 | 4 | X | X |

What is claimed is:

1. An aqueous liquid toy composition for forming soap bubbles, consisting essentially of, an emulsifier, water, a thickener and a sweetening, wherein the emulsifier is an ester of a fatty acid, having 8 to 14 carbon atoms with a polyhydric alcohol selected from polyglycerol optionally with an ionic emulsifier, the percentage of esterified hydroxyl groups of said polyhydric alcohol being 1 to 25% based on total hydroxyl groups of the polyhydric alcohol, wherein the thickener is selected from the group consisting of microbe-yielded viscous materials, plant seed viscous materials, sea weed extracts, vegetable resin viscous materials, plant fruit viscous materials, and celluloses, wherein the sweetening is selected from the group consisting of starch syrup, glucose, sorbitol and sucrose, whereby the aqueous liquid toy composition is prepared using edible raw materials, and, when ingested, has substantially no bitter taste and a high safety.

2. An aqueous liquid toy composition according to claim 1, wherein the content of said ester is 0.1 to 10% by weight based on the weight of said aqueous liquid.

3. An aqueous liquid toy composition according to claim 2, wherein said thickener consist essentially of a polysaccharide.

4. An aqueous liquid toy composition according to claim 3, wherein the content of said polysaccharide is 0.001 to 5% by weight based on the weight of said aqueous liquid.

5. An aqueous liquid toy composition according to claim 1, which further consist essentially of an ionic emulsifier.

6. An aqueous liquid toy composition according to claim 5, wherein the amount of said ionic emulsifier is 0.1 to 20% by weight based on the weight of said ester.

7. An aqueous liquid toy composition according to claim 1, wherein the content of said sweetening is 0.1 to 20% by weight based on the weight of said aqueous liquid.

8. An aqueous liquid toy composition according to claim 1, wherein said thickener is selected from the group consisting of xanthan gum, guar gum, carrageenan, locust bean gum and a mixture of guar gum and xanthan gum; and said sweetening is selected from the group consisting of glycerol, starch syrup, glucose, sorbitol and sucrose.

9. A method of preparing an aqueous liquid toy composition for forming soap bubbles, consisting essentially of dissolving an emulsifier, a thickener and a sweetening in water, wherein the emulsifier is an ester of a fatty acid having 8 to 14 carbon atoms with a polyhydric alcohol selected from polyglycerol, the percentage of esterified hydroxyl groups of said polyhydric alcohol being 1 to 25% based on total hydroxyl groups of the polyhydric alcohol, wherein the thickener is selected from the group consisting of microbe-yielded viscous materials, plant seed viscous materials, sea weed extracts, vegetable resin viscous materials, plant fruit viscous materials, and celluloses, wherein the sweetening is selected from the group consisting of starch syrup, glucose, sorbitol and sucrose, whereby the aqueous liquid toy composition is prepared using edible raw materials, and, when ingested, has substantially no bitter taste and a high safety.

10. A method of playing by forming soap bubbles, which comprises blowing an aqueous liquid toy composition consisting essentially of an emulsifier, water, a thickener and a sweetening, wherein the emulsifier is an ester of a fatty acid having 8 to 14 carbon atoms with a polyhydric alcohol selected from polyglycerol, the percentage of esterified hydroxyl groups of said polyhydric alcohol being 1 to 25% based on total hydroxyl groups of the polyhydric alcohol, wherein the thickener is selected from the group consisting of microbe-yielded viscous materials, plant seed viscous materials, sea weed extracts, vegetable resin viscous materials, plant fruit viscous materials, and celluloses, wherein the sweetening is selected from the group consisting of starch syrup, glucose, sorbitol and sucrose, whereby the aqueous liquid toy composition is prepared using edible raw materials, and, when ingested, has substantially no bitter taste and a high safety.

* * * * *